US006629823B2

(12) United States Patent
Ota et al.

(10) Patent No.: US 6,629,823 B2
(45) Date of Patent: Oct. 7, 2003

(54) COMPRESSORS

(75) Inventors: Masaki Ota, Kariya (JP); Tomoji Tarutani, Kariya (JP); Tomohiro Wakita, Kariya (JP); Kenta Nishimura, Kariya (JP); Yoshinori Inoue, Kariya (JP); Masafumi Ito, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 86 days.

(21) Appl. No.: 09/836,713

(22) Filed: Apr. 17, 2001

(65) Prior Publication Data

US 2001/0031205 A1 Oct. 18, 2001

(30) Foreign Application Priority Data

Apr. 18, 2000 (JP) ..... 2000-116961

(51) Int. Cl.[7] ..... F04B 1/26
(52) U.S. Cl. ..... 417/222.1; 417/269
(58) Field of Search ..... 417/222.1, 269, 417/222.2

(56) References Cited

U.S. PATENT DOCUMENTS 5,785,503 A 7/1998 Ota et al. ..... 417/269
6,116,145 A * 9/2000 Ota et al. ..... 92/12.2
6,139,283 A * 10/2000 Ahn ..... 417/222.2
6,186,048 B1 * 2/2001 Kimura et al. ..... 92/71
6,368,069 B1 * 4/2002 Fukanuma et al. ..... 417/222.2

FOREIGN PATENT DOCUMENTS

JP 2000-073945 3/2000 ..... F04B/27/08

* cited by examiner

*Primary Examiner*—Charles G. Freay
*Assistant Examiner*—Michael K. Gray
(74) *Attorney, Agent, or Firm*—Morgan & Finnegan, LLP

(57) ABSTRACT

Compressor are taught that may include a suction port to draw refrigerant and a discharge port to discharge compressed refrigerant. A driving shaft is disposed within a compressor driving chamber. A swash plate is inclinably and slidably coupled to the driving shaft. The swash plate rotates together with the driving shaft at an inclination angle with respect to a plane perpendicular to the rotational axis of the driving shaft. A cylinder bore is disposed adjacent to the compressor driving chamber. A piston is disposed within the cylinder bore and an end portion of the piston is connected to a peripheral edge of the swash plate by a shoe. Preferably, the piston reciprocates within the cylinder bore to compress the refrigerant in response to rotation of the inclined swash plate. A rotor is connected to the driving shaft. A hinge mechanism connects the swash plate with the rotor and transmits torque from the driving shaft to the swash plate regardless of the inclination angle of the swash plate. The hinge mechanism includes a projection disposed on one of the rotor or the swash plate and at least one arm disposed on the other of the rotor or the swash plate. The projection has a recessed structure and at least one arm is coupled to the projection to transmit torque from the driving shaft.

25 Claims, 6 Drawing Sheets

COMPRESSORS

BACKGROUND OF THE INVENTION

1. Technical Field

The present invention relates to compressors that may compress a refrigerant by utilizing a swash plate and particularly to compressors that may rotate the swash plate using a relatively lightweight structure. Such compressors may be utilized in air conditioning systems and more preferably in automobile air conditioning systems.

2. Description of the Related Art

One type of variable displacement compressor is disclosed in U.S. Pat. No. 6,010,312 and includes a swash plate coupled to a driving shaft disposed within a compressor driving chamber and pistons slidably inserted into respective cylinder bores. The end portion of each piston is engaged with the swash plate by means of a shoe. The swash plate is inclinably and slidably coupled to a rotor by a hinge mechanism. The rotor is fixed to the driving shaft. When the pressure within the driving chamber increases or decreases in order to change the inclination angle of the swash plate, the piston stroke is changed in response to the change of the inclination angle. As the result, the compressor output discharge capacity changes.

The hinge mechanism includes an arm that projects from the surface of the swash plate and a groove that is formed on the rotor surface. The arm is engaged with the groove such that the inner sidewall of the groove slidably contacts the outer sidewall of the arm. Thus, torque from the driving shaft is transmitted to the swash plate by means of the groove and the arm. When the inclination angle of the swash plate changes in order to change the compressor output discharge capacity, a bottom surface of the groove on the rotor may restrict the upper dead point (top clearance) of the piston to a constant position by slidably connecting the curved surface of top end portion of the arm. The hinge mechanism rotates together with the driving shaft and therefore, the hinge mechanism is required to be lightened in view of the centrifugal force exerted to the hinge mechanism due to the rotation together with the driving shaft. On the other hand, the hinge mechanism receives the reaction force of the piston in the axial direction of the driving shaft when the piston compresses the refrigerant and therefore, the hinge mechanism is required to have certain width in the rotating direction in order to reduce the unit area load that receives the reaction force. Such requirement with respect to the dimension of the hinge mechanism that receives the reaction force of the piston is contrary, to the requirement of the lightening of the hinge mechanism in view of the centrifugal force due to the rotation of the hinge mechanism. Further, when the reaction force of the piston becomes stronger, the width of the hinge mechanism is required to be wider and that made it difficult to reduce the weight of the hinge mechanism.

SUMMARY OF THE INVENTION

It is, therefore, an object of the present invention to provide compressors that may reduce the weight of the torque transmitting structure between the driving shaft and the swash plate.

Preferably, a compressor may include a suction port and a discharge port. The suction port may draw refrigerant into the compressor. The discharge port may discharge the refrigerant from the compressor. Further, the compressor may include a swash plate, a piston, a rotor and a hinge mechanism within a compressor driving chamber. The swash plate may be rotatably coupled to a driving shaft that is disposed within the driving chamber. The swash plate may rotate together with the driving shaft at an inclination angle with respect to a plane perpendicular to the driving shaft. The rotor may be connected to the driving shaft within the driving chamber. The hinge mechanism may connect the swash plate with the rotor and may transmit the torque of the driving shaft to the swash plate regardless of the inclination angle of the swash plate. The piston may be disposed in a cylinder bore and the end portion of the piston may be connected to a peripheral edge of the swash plate by means of a shoe. The piston may reciprocate in the cylinder bore to compress the refrigerant in response to the rotation of the inclined swash plate. Preferably, the piston may change the piston stroke to change an output discharge capacity of the compressor when the inclination angle of the swash plate is changed in response to the pressure state within the driving chamber.

In a preferred aspect of the present teachings, the hinge mechanism may include a projection and at least one arm. The projection may be disposed on either of the rotor and the swash plate. The arm may be disposed on the other of the rotor and the swash plate. The projection may have a recessed structure and the arm may be coupled to the projection to transmit the torque of the driving shaft. Because the projection may have a recessed structure, the weight of the hinge mechanism can be reduced and the projection can still provide sufficient width to receive the reaction force of the piston.

Other objects, features and advantages of the present invention will be readily understood after reading the following detailed description together with the accompanying drawings and the claims.

DETAILED DESCRIPTION OF THE INVENTION

Figure 1:
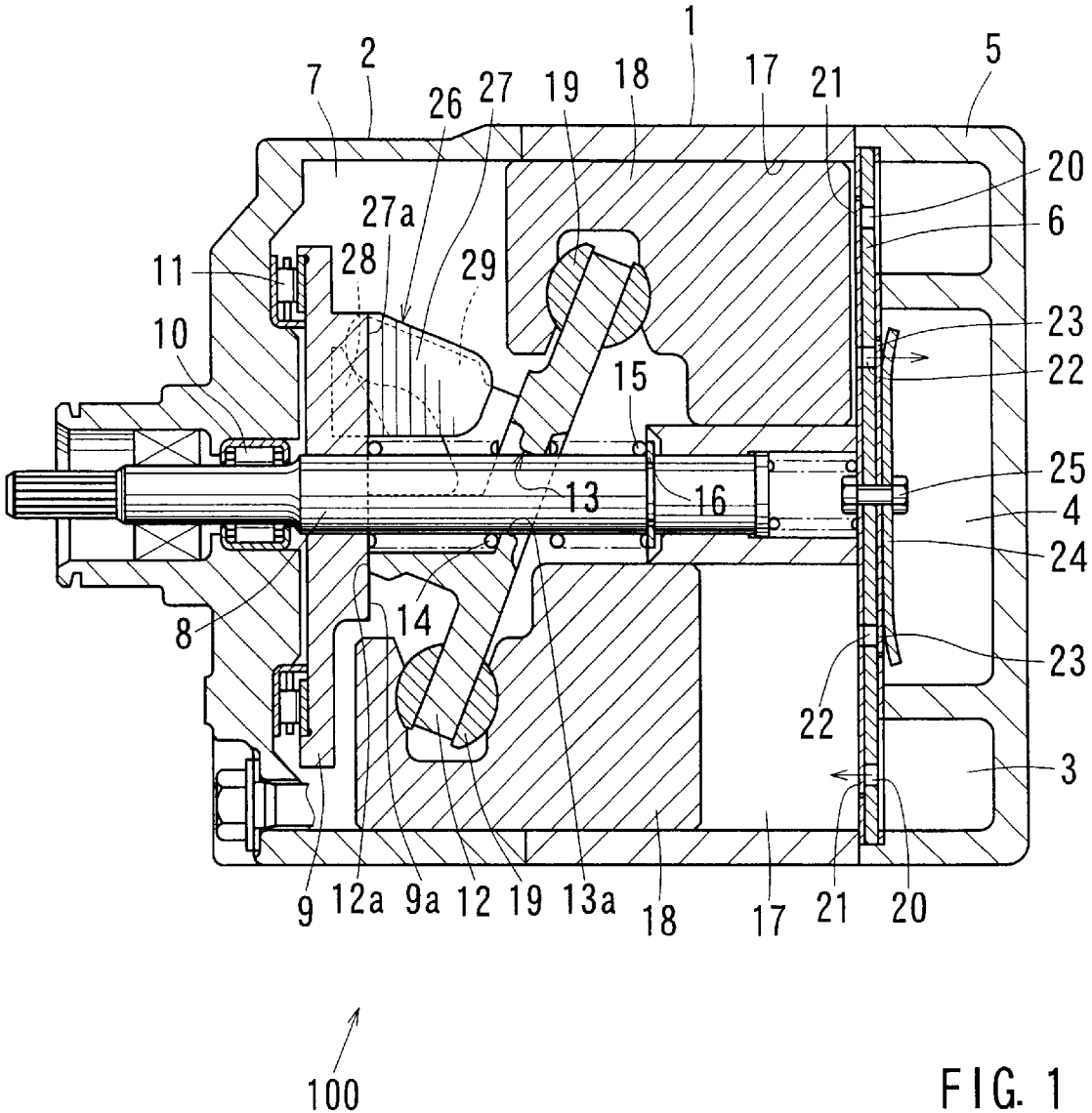
FIG. 1 shows a compressor according to a first representative embodiment.

Representative compressors according to the present teaching may include a suction port adapted to draw refrigerant and a discharge port adapted to discharge compressed refrigerant. The compressor may further include a swash plate. The swash plate may be inclinably and slidably coupled to a driving shaft disposed within a compressor driving chamber. The swash plate may rotate together with the driving shaft at an inclination angle with respect to a plane perpendicular to the driving shaft. The compressor may have a piston disposed in a cylinder bore. The end portion of the piston may be connected to the peripheral edge of the swash plate by means of a shoe and the piston may reciprocate in the cylinder bore to compress the refrigerant in response to the rotation of the inclined swash plate. Preferably, the piston may change the piston stroke to change the output discharge capacity of the compressor when the inclination angle of the swash plate is changed in response to the changes in the pressure within the driving chamber. The representative compressor may further have a rotor connected to the driving shaft within the driving chamber and a hinge mechanism that connects the swash plate with the rotor. The hinge mechanism may transmit the torque of the driving shaft to the swash plate regardless of the inclination angle of the swash plate. The hinge mechanism may include a projection and at least one arm. The projection may be disposed on the rotor while the arm(s) may be disposed on the swash plate. In the alternative, the projection may be disposed on the swash plate while the arm(s) is (are) disposed on the rotor. The arm(s) may be coupled to the projection in order to transmit the torque from the driving shaft to the swash plate. Further, the projection may have a recessed structure. Due to the recessed structure, the weight of the projection can be reduced in order to reduce the total weight of the hinge mechanism in light of the centrifugal force caused by the rotation of the hinge mechanism. At the same time, the projection can still provide sufficient width to receive the reaction force of the piston, because the recessed structure does not reduce the width of the projection that receives the reaction force.

In the representative compressors, the hinge mechanism may preferably include an axial force receiving portion. The axial force receiving portion may bear the axial force that is exerted onto the swash plate when the piston compresses the refrigerant. In the compressor, the hinge mechanism may preferably be disposed to correspond to the compression zone where the swash plate receives the reaction force of the piston when the piston compresses the refrigerant within the cylinder bore. For example, the hinge mechanism may preferably shift to the center of the compression zone.

Further, the recessed structure may be disposed within the projection so as to shift in the rotating direction of the swash plate. By shifting the recessed structure in the rotating direction of the swash plate, the projection can have a sufficient thickness in order to receive the rotation torque from the arm(s) when the hinge mechanism transmits the torque of the driving shaft to the swash plate. The recessed structure may preferably penetrate the projection so as to reduce the weight of the projection. The recessed structure may be further defined in various ways, including as a cut-out portion and/or a hollow portion.

Each of the additional features and method steps disclosed above and below may be utilized separately or in conjunction with other features and method steps to provide improved air conditioning systems and methods for designing and using such air conditioning systems. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention, which detailed description will now be given with reference to the accompanying drawings.

The following detailed representative embodiments may be utilized as a compressor for an automotive air conditioning system. This compressor may draw, compress and discharge refrigerant to operate the air conditioning circuit such as a cooling circuit. Naturally, other uses of the present compressors are contemplated.

As shown in FIG. 1, a front housing 2 is coupled to the front end of a cylinder block 1 that defines one part of the outer wall of a compressor 100. A rear housing 5 that defines a suction chamber 3 and a discharge chamber 4 is coupled to the back end of the cylinder block 1 via a valve plate 6. A driving shaft 8 connected to a power source penetrates the driving chamber 7 within the front housing 2. The driving shaft 8 is rotatably supported by the cylinder block 1 and by the front housing 2.

Within the driving chamber 7, a rotating swash plate 12 is inclinably and slidably coupled to the driving shaft 8 via a rotor 9. The rotor 9 is coupled to the driving shaft 8. The driving shaft 8 is rotatably supported by bearings. In FIG. 1, a bearing 10 that supports one end portion of the driving shaft 8 is shown. The bearing 10 is disposed within the front housing 2. The rotor 9 is rotatably supported by a bearing 11 that is disposed within the front housing 2. The driving shaft 8 extends through a penetration hole 13 formed in the swash plate 12. The swash plate 12 may be inclinably and slidably coupled to the driving shaft 8. A hinge mechanism 26 is provided between the rotor 9 and the swash plate 12 to transmit the torque of the driving shaft 8 to the swash plate 12 that may rotate at various inclination angles. In order to allow the swash plate 12 to inline, the penetration hole 13 preferably has a support point 13*a*.

A spring 14 may be mounted on the driving shaft 8 between the rotor 9 and the swash plate 12 and a spring 15 may be mounted on the driving shaft 8 between the swash plate 12 and the cylinder block 1. The swash plate 12 may initially incline with respect to the plane perpendicular to the axis of the driving shaft 8 by way of the springs 14 and 15 when the compressor is not in operation. The spring 15 disposed within the cylinder block 1 is engaged by a snap ring 16.

The cylinder block 1 preferably includes six cylinder bores 17. However, FIG. 1 only shows two pistons for purposes of illustration. Each piston 18 is reciprocally inserted into each cylinder bore 17. The piston 18 is coupled to the swash plate 12 via a shoe 19. The rotational movement of the swash plate 12 is converted into reciprocating movement of the pistons 18 via the shoe 19. As the result of the reciprocation of the piston 18, refrigerant in the suction chamber 3 is drawn into the cylinder bore 17 for compression from a suction port 20 via a suction valve 21. Then, the compressed refrigerant is discharged from a discharge port 22 to the discharge chamber 4 via a discharge valve 23. The suction valve 21, the discharge valve 23, and a valve retainer 24 are mounted on the valve plate 6 by utilizing a fastening screw 25. The driving chamber 7 preferably communicates with the discharge chamber 4 via a capacity control passage (not shown) that is opened and closed by a capacity control valve (not shown). The pressure state within the driving chamber 7 is controlled by the opening and closing the capacity control passage.

Figure 2:
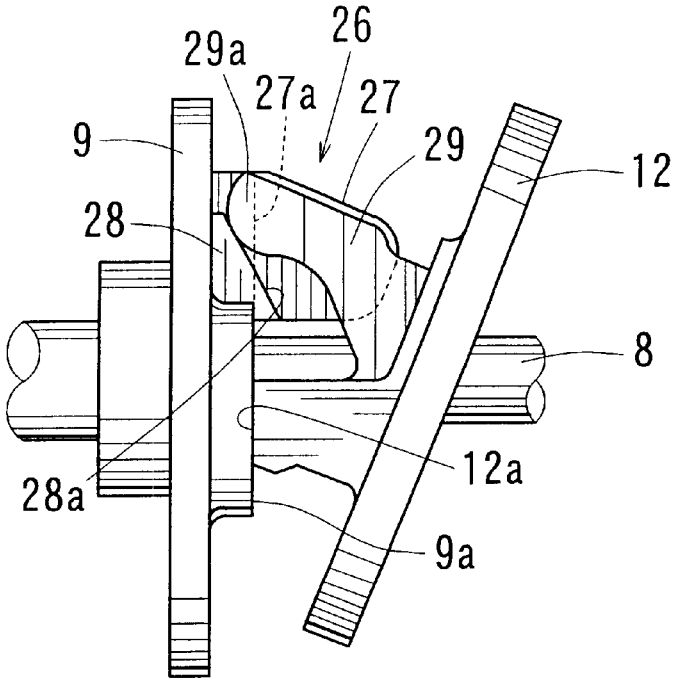
FIG. 2 shows a detailed side view of the hinge mechanism of the first representative embodiment.
Figure 3:
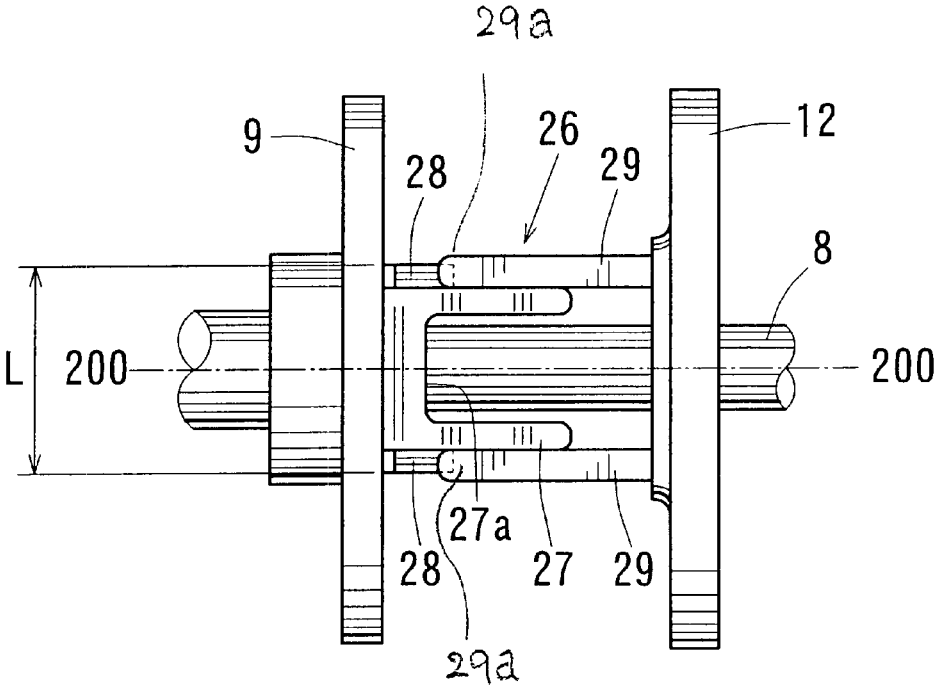
FIG. 3 shows detailed plain view of the hinge mechanism of the first representative embodiment.

As shown in FIGS. 1 to 3, the hinge mechanism 26 connects the swash plate 12 with the rotor 9 in order to transmit torque from the driving shaft 8 to the swash plate 12. The hinge mechanism 26 allows the swash plate 12 to change the inclination angle with respect to the plane perpendicular to the axis of the driving shaft 8. The hinge mechanism 26 includes a protrusion 27, cam members 28 and a pair of arms 29. The protrusion 27 is integrally coupled to the rotor 9, and a pair of the cam members 28 is respectively engaged with the side surfaces of the protrusion 27. Protrusion 27 preferably has a cutout construction, such as recess 27*a*. The arms 29 are integrally coupled to the swash plate 12 and the side of the swash plate 12 that faces the rotor 9.

The arms 29 are disposed so as to sandwich the protrusion 27 in order to receive the torque that is transmitted from the protrusion 27 when the rotor 9 rotates together with the driving shaft 8. Head portions 29*a* of the arms 29 have a curved shape and contact cam surfaces 28*a* of the cam members 28, respectively. The cam members 29 include axial load accepting portions at the top end of the head portion 29*a*. The cam surface 28*a* has a slanting surface that tilts forward in order to maintain the upper dead point (top clearance) of the pistons 18 at a constant position regardless of variations in the inclination angle of the swash plate 12.

When the swash plate 12 rotates at a certain inclination angle, piston 18 compresses the refrigerant within the cylinder bore 17 while another piston draws the refrigerant into another cylinder bore. In response to the pistons that compress the refrigerant within the cylinder bore during the operation of the compressor 100, the swash plate 12 receives a reaction force from the pistons 18 to push the swash plate 12 away from the piston 18. The area of the swash plate 12 where the swash plate 12 receives such reaction force is defined as a compression zone. Also, in response to the pistons that draw the refrigerant within the cylinder bore during the operation of the compressor 100, the swash plate 12 receives a reaction force from the piston 18 to pull the swash plate 12 towards the piston 18. The area of the swash plate 12 where the swash plate 12 receives such reaction force is defined as a drawing zone. The hinge mechanism 26 is disposed between the rotor 9 and the swash plate 12 so as to straddle the boundary line 200—200 between the compression zone and the drawing zone.

In the compressor 100, when the driving shaft 8 rotates together with the rotor 9, the swash plate 12 rotates via the hinge mechanism 26 and the piston 18 reciprocates within the cylinder bore 17. As the result, the refrigerant in the suction chamber 3 is drawn into the cylinder bore 17 via the suction port 20 and the suction valve 21. Then, the compressed high pressure refrigerant is discharged from the discharge port 22 via the discharge valve 23 to the discharge chamber 4.

The output discharge capacity of the compressor 100 can be changed by changing the length of the piston stroke as a result of changing the inclination angle of the swash plate 12. Changing the pressure within the driving chamber 7 can change the inclination angle of the swash plate 12. More specifically, when the pressure within the driving chamber 7 increases, backpressure acting on the piston 18 increases and the inclination angle of the swash plate 12 decreases with respect to the plane perpendicular to the driving shaft 8. As the inclination angle of the swash plate 12 decreases, the arm head portion 29*a* of the arm 29 moves towards the driving shaft 8 and the arm head portion 29*a* is pushed by the cam surface 28*a*. Thus, the swash plate 12 slides towards the cylinder block 1 (to the right in FIG. 2) and the swash plate 12 inclines to decrease its inclination angle. As the result, the piston stroke length decreases and the compressor output discharge capacity decreases.

To the contrary, when the pressure within the driving chamber 7 decreases, the backpressure acting on the pistons 18 decreases and the inclination angle of the swash plate 12 increases. The arm head portion 29*a* of the arm 29 moves away from the driving shaft 8 and slides up along the cam surface 28*a*. The swash plate 12 simultaneously slides toward the rotor 9. Thus, the swash plate 12 inclines to increase its inclination angle and the piston stroke length increases, thereby increasing the compressor output discharge capacity. The maximum inclination angle of the swash plate 12 with respect to the maximum output discharge capacity is defined by the contact of an abutting surface 12*a* formed on the front surface of the swash plate 12 against a rear surface 9*a* of the rotor 9.

Due to the hinge mechanism 26, the rotation of the rotor 9 is transmitted to the swash plate 12 by the protrusion 27 and the pair of arms 29. When the inclination angle of the swash plate 12 changes, the position of the arm 29 is determined by the cam surface 28*a* of the cam member 28. Therefore, the upper dead point of the piston 18 can be held in an almost constant position.

In this embodiment, the protrusion 27 includes a recessed structure 27*a*. Therefore, the weight of the protrusion 27 can be reduced while the horizontal width L (FIG. 3) that receives the reaction force of the piston 18 loaded onto the swash plate 12 can be substantially increased and the swash plate 12 can be supported in a stable manner.

Figure 4:
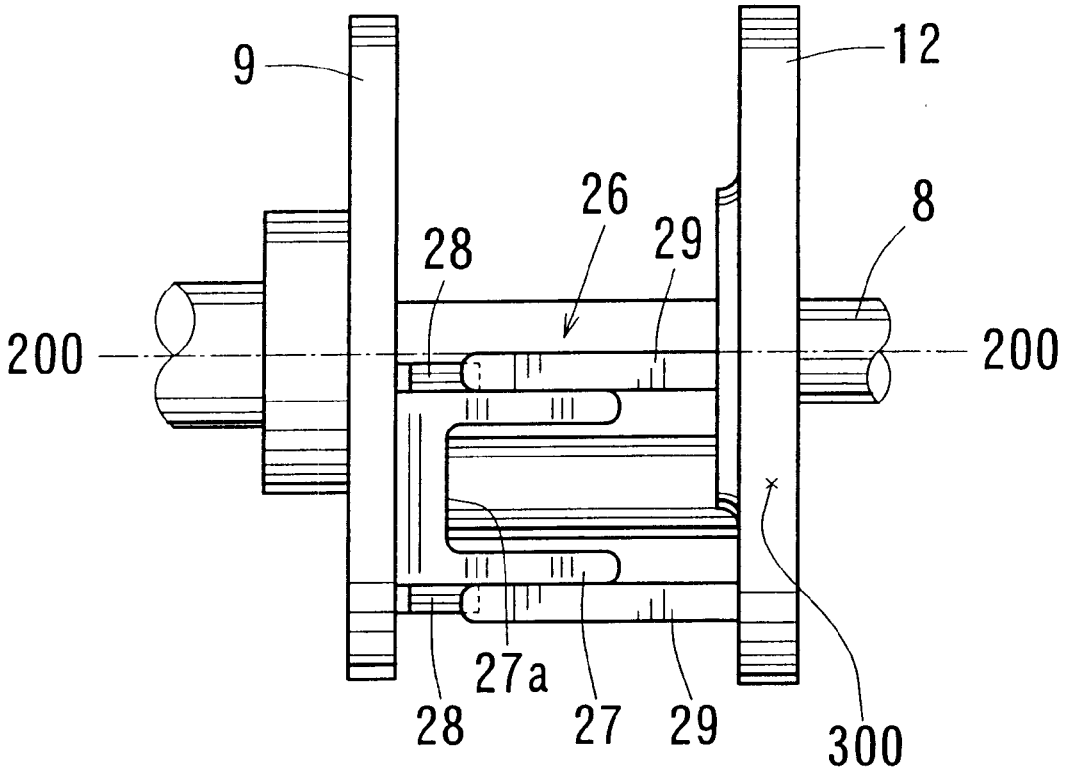
FIG. 4 shows detailed constructions of the hinge mechanism according to another representative embodiment.

Another representative embodiment is shown in FIG. 4. In this embodiment, the hinge mechanism 26 includes the projection 27 disposed on the rotor 9 and the arms 29 on the swash plate 12. The location of the projection 27 and the arms 29 are shifted in the circumferential direction of the swash plate 12 to correspond to the compression zone 300. The compression zone 300 is defined as the area where the swash plate 12 receives the reaction force of the piston 18 when the piston 18 compresses the refrigerant, within the cylinder bore 17. The elements of the compressor other than the disposition of the hinge mechanism 26 are identical to the elements of the first embodiment. According to this embodiment, the compression zone of the swash plate 12 can be supported by the hinge mechanism 26 and therefore, twisting of the swash plate 12 can be prevented and smooth inclination of the swash plate 12 is enabled.

Figure 5:
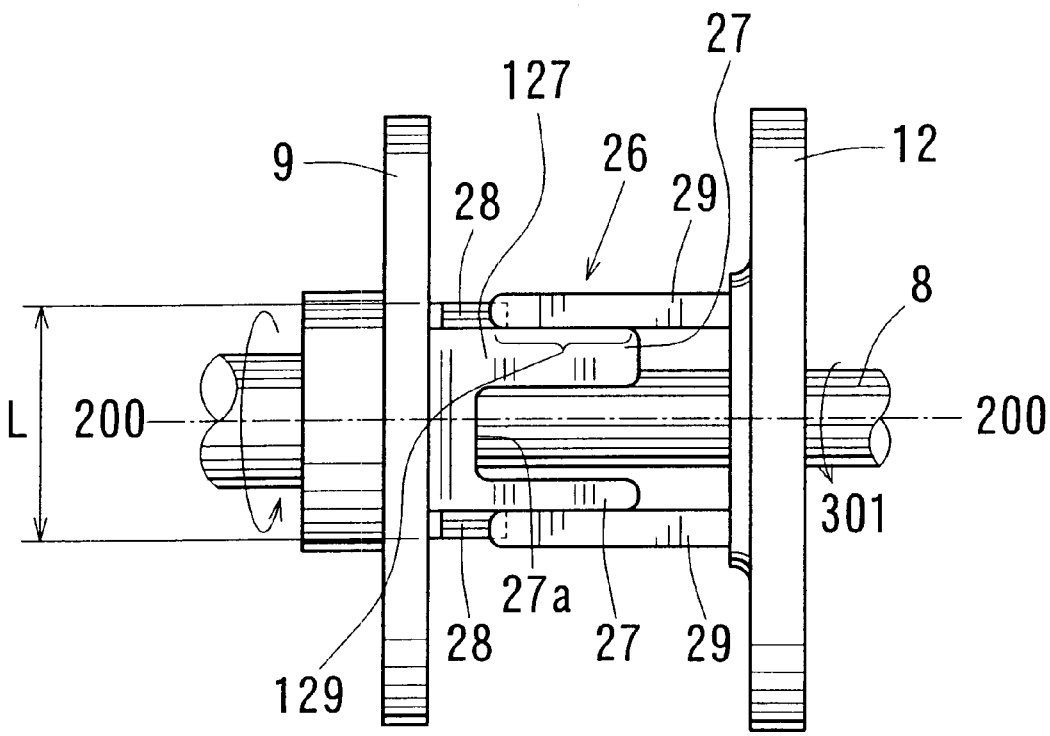
FIG. 5 shows detailed constructions of the hinge mechanism according to another representative embodiment.
Figure 6:
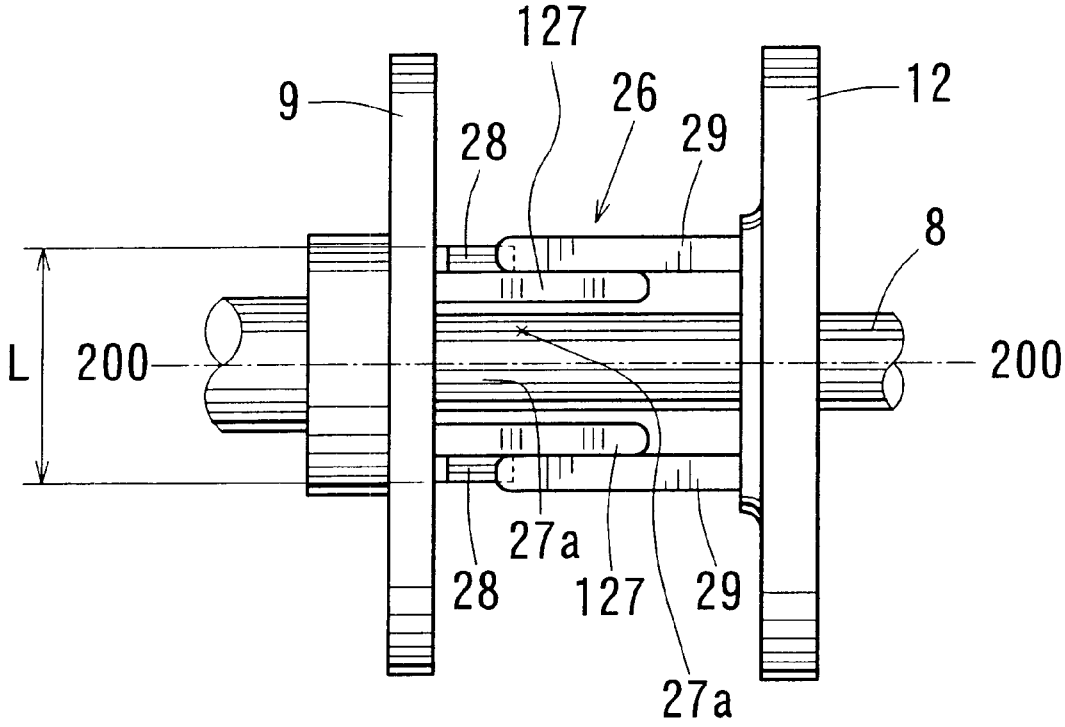
FIG. 6 shows detailed constructions of the hinge mechanism according to another representative embodiment.

Further, as shown in FIG. 5, the recessed structure 27*a* of the projection 27 may preferably shift in the rotating direction 301 of the swash plate 12. By shifting the recessed structure 27*a* in the rotating direction 301 of the swash plate 12, the left-side projection member 127 has a sufficient thickness at the torque transmitting area 129 to receive the rotating torque of the driving shaft 8. Further, as shown in FIG. 6, the center portion of the protrusion 27 may be completely removed such that the recessed structure 27*a* penetrates the projection 27 to reduce the weight of the projection 27 in the light of the centrifugal force caused by the rotation of the hinge mechanism 26. In this embodiment, a plurality of protrusions 127, 128 corresponding to each of the arms 29 may be formed.

Figure 7:
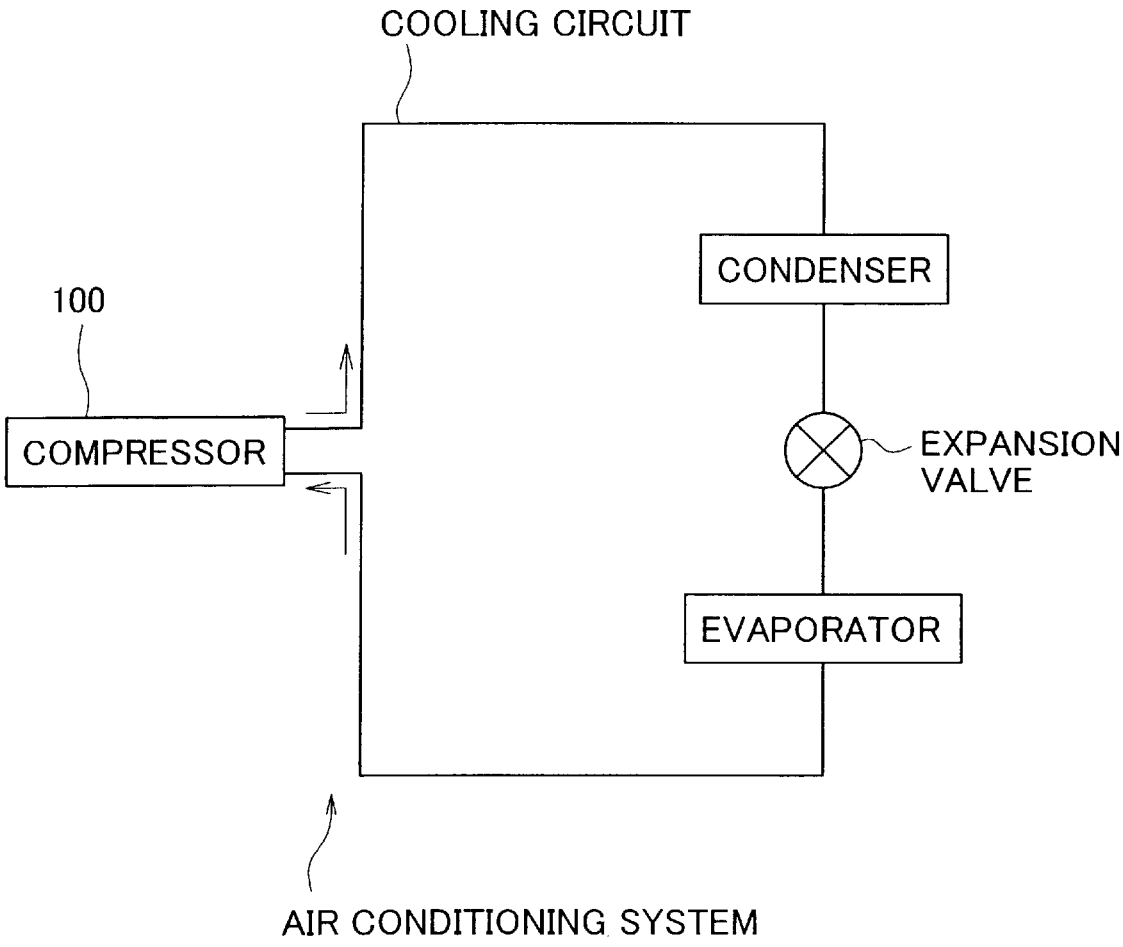
FIG. 7 shows an air conditioning system for an automobile including the compressor according to the representative embodiment.

Further, as one example, an air conditioning system that includes the compressor 100 is shown in FIG. 7, wherein the refrigerant to operate the air conditioning system is compressed by the compressor.

The invention is not limited to the above described embodiments. For example, three arms 29 may be used, the central arm may be inserted into the recessed structure 27*a* of the protrusion 27, a cam member 28 may be disposed on the bottom of the recessed structure 27*a*, and the head portion of the arms 29 may contact with the cam surface 28*a* of the cam member 28. Moreover, the arms 29 may be coupled to the rotor 9 while the protrusion 27 and the cam member 28 may be coupled to the swash plate 12.

What is claimed is:

1. A compressor having a suction port to draw refrigerant and a discharge port to discharge compressed refrigerant, comprising:

a driving shaft disposed within a compressor driving chamber, a swash plate inclinably and slidably coupled to the driving shaft, the swash plate rotating together with the driving shaft at an inclination angle with respect to a plane perpendicular to the rotational axis of the driving shaft, a cylinder bore disposed adjacent to the compressor driving chamber, a piston disposed within the cylinder bore, an end portion of the piston connected to a peripheral edge of the swash plate by a shoe, the piston reciprocating within the cylinder bore to compress the refrigerant in response to rotation of the inclined swash plate, a rotor connected to the driving shaft and a hinge mechanism connecting the swash plate with the rotor, the hinge mechanism transmitting torque from the driving shaft to the swash plate regardless of the inclination angle of the swash plate, wherein:

the hinge mechanism has a projection disposed on one of the rotor or the swash plate, a pair of arms disposed on the other of the rotor or the swash plate, and axial force receiving portions disposed on each outer side surface of the projection, the projection has a recessed structure and the pair of arms is coupled to the projection to transmit torque from the driving shaft, and the axial force receiving portions engage with respective front end portions of the arms and bear the axial force of the piston exerted onto the swash plate when the piston compresses the refrigerant within the cylinder bore.

2. A compressor according to claim 1, wherein the piston can change the piston stroke length to change the compressor output discharge capacity when the inclination angle of the swash plate is changed in response to a change in pressure within the driving chamber.

3. A compressor according to claim 1, wherein the arms are coupled respectively to each outer side surface of the projection to transmit torque from the driving shaft to the swash plate.

4. A compressor according to claim 1, wherein the recessed structure is disposed between the two arms elements.

5. A compressor according to claim 1, wherein the recessed structure of the projection shifts in the rotation direction of the swash plate during operation.

6. A compressor according to claim 1, wherein the projection is disposed on the rotor and the arm is disposed on the swash plate.

7. A compressor according to claim 1, wherein the hinge mechanism is disposed to correspond to the compression zone where the swash plate receives a reaction force when the piston compresses the refrigerant within the cylinder bore.

8. A compressor according to claim 1, wherein the recessed structure is formed to penetrate the projection.

9. An air conditioning system for an automobile comprising a cooling circuit and the compressor of claim 1, wherein the refrigerant to operate the cooling circuit is compressed by the compressor.

10. A compressor according to claim 3, wherein each axial force receiving a portion is disposed adjacent to the projection and includes a cam surface, and the front end portion of each arm slides along the cam surface of each axial force receiving portion in response to the inclination angle of the swash plate.

11. A compressor according to claim 10, wherein each axial force receiving portion is disposed adjacent to each outer surface of the projection.

12. A compressor according to claim 10, wherein the front end portion of each arm applies the axial force to the cam surface of each axial force receiving portion only in a direction toward the cam surface.

13. A compressor according to claim 10, wherein the front end portion of each arm contacts with the cam surface of each axial force receiving portion only in a direction toward the cam surface.

14. A compressor according to claim 10, wherein the cam surface of each axial force receiving portion comprises an inclined surface having a length in a direction of inclination.

15. A compressor, comprising:

a hinge mechanism coupling a swash plate to the rotor, the hinge mechanism transmitting torque from a driving shaft to the swash plate regardless of an inclination angle of the swash plate, wherein the hinge mechanism comprises:

a projection disposed on one of the rotor or the swash plate, wherein the projection has a recessed structure, a pair of arms disposed on the other of the rotor or the swash plate, wherein the arms are coupled to the projection to transmit torque from the driving shaft, and axial force receiving portions disposed on each outer side surface of the projection, each axial force receiving portion bearing the axial force from a piston that is exerted onto the swash plate when the piston compresses a refrigerant within a cylinder bore, and each axial force receiving portion being engaged respectively with each front end portion of the arms.

16. A compressor according to claim 15, wherein the each arm is coupled respectively to each outer side surface of the projection to transmit torque from the driving shaft to the swash plate.

17. A compressor according to claim 15, wherein the recessed structure is disposed between the two arm elements.

18. A compressor according to claim 15, wherein the recessed structure of the projection shifts in the rotating direction of the swash plate during operation.

19. A compressor according to claim 15, wherein the hinge mechanism is disposed to correspond to the compression zone where the swash plate receives a reaction force when the piston compresses the refrigerant within the cylinder bore.

20. An air conditioning system for an automobile comprising a cooling circuit and the compressor of claim 15, wherein the refrigerant to operate the cooling circuit is compressed by the compressor.

21. A compressor, comprising:

a hinge mechanism coupling a swash plate to the rotor, the hinge mechanism transmitting torque from a driving shaft to the swash plate regardless of an inclination angle of the swash plate, wherein the hinge mechanism comprises:

a projection disposed on one of the rotor or the swash plate, wherein the projection has a recessed structure, a pair of arms disposed on the other of the rotor or the swash plate, wherein the arms are coupled to the projection to transmit torque from the driving shaft, and a pair of axial force receiving portions disposed on each outer surface of the projection, each axial force receiving portion opposing to and contacting with a front end portion of each arm.

22. A compressor according to claim 21, wherein each axial force receiving portion includes a cam surface, and the front end portion of each arm slides along the cam surface in response to the inclination angle of the swash plate.

23. A compressor according to claim 22, wherein the front end portion of each arm applies the axial force to the cam surface of each axial force receiving portion only in a direction toward the cam surface.

24. A compressor according to claim 22, wherein the front end portion of each arm contacts with the cam surface of each axial force receiving portion only in a direction toward the cam surface.

25. A compressor according to claim 22, wherein the cam surface of each axial force receiving portion comprises an inclined surface having a length in a direction of inclination.

* * * * *